US012529298B1

(12) United States Patent
Gramlich et al.

(10) Patent No.: US 12,529,298 B1
(45) Date of Patent: Jan. 20, 2026

(54) INTEGRATED BYPASS AND FLOWBACK SYSTEMS AND METHODS FOR WELL FRACTURING

(71) Applicant: Bestway Oilfield, Inc., Channelview, TX (US)

(72) Inventors: Don Channing Gramlich, Richmond, TX (US); Mehul Jain, Humble, TX (US)

(73) Assignee: Bestway Oilfield, Inc., Channelview, TX (US)

( * ) Notice: Subject to any disclaimer, the term of this patent is extended or adjusted under 35 U.S.C. 154(b) by 0 days.

(21) Appl. No.: 19/233,902

(22) Filed: Jun. 10, 2025

Related U.S. Application Data

(60) Provisional application No. 63/692,145, filed on Sep. 8, 2024.

(51) Int. Cl.
*E21B 43/26* (2006.01)
*E21B 34/02* (2006.01)
*E21B 43/14* (2006.01)

(52) U.S. Cl.
CPC ..... *E21B 43/2607* (2020.05); *E21B 34/02* (2013.01); *E21B 43/14* (2013.01)

(58) Field of Classification Search
CPC ..... E21B 43/2607; E21B 34/02; E21B 43/14; E21B 34/025; E21B 33/068; E21B 43/26
See application file for complete search history.

(56) References Cited

U.S. PATENT DOCUMENTS

| | | | | |
|---|---|---|---|---|
| 10,738,569 | B2 * | 8/2020 | Tran | E21B 43/2607 |
| 11,091,993 | B2 * | 8/2021 | Sizemore | E21B 43/267 |
| 11,867,023 | B2 * | 1/2024 | Beason | E21B 43/2607 |
| 11,867,043 | B1 * | 1/2024 | Adams | F16K 37/005 |
| 11,976,542 | B1 * | 5/2024 | Duhn | E21B 21/106 |
| 12,196,067 | B1 * | 1/2025 | Yeung | E21B 43/12 |
| 2017/0275980 | A1 * | 9/2017 | Kajaria | F16L 55/07 |
| 2021/0079902 | A1 * | 3/2021 | Yeung | F04B 53/18 |
| 2023/0167709 | A1 * | 6/2023 | Beason | F16N 29/02 |
| 2023/0175375 | A1 * | 6/2023 | Yeung | B01F 23/59 166/308.1 |
| 2025/0116187 | A1 * | 4/2025 | Drews | E21B 47/06 |
| 2025/0224301 | A1 * | 7/2025 | Yeung | E21B 34/08 |

* cited by examiner

*Primary Examiner* — Daniel P Stephenson
(74) *Attorney, Agent, or Firm* — Johnston IP Law, PLLC

(57) ABSTRACT

A method for fracking at least two wells includes the steps of delivering high pressure fracking fluid to a first frack tree, fracking a first well associated with the first frac tree, delivering high pressure fracking fluid from the first frac tree to a second frac tree through a bypass line fluidly coupled to the first frac tree and the second frac tree while maintaining delivery of the high pressure fracking fluid to the first frac tree, delivering high pressure fracking fluid to the second frac tree from the original source of fracking fluid, and fluidly isolating the first well. High pressure fluid is continuously supplied by the original source of high pressure fluid while performing the steps of the method. An apparatus for performing the method includes a bypass line fluidly coupling the first and second wells.

20 Claims, 14 Drawing Sheets

TRADITIONAL FRACKING PAD 1-
PAD 2 ISOLATED
PUMPING PAD 1 -
P1-V1 - OPEN
P1-BL-V1 - OPEN
P1-V2 - OPEN
P1-C1 - CLOSED
P2-BL-V1 - CLOSED
P2-C1 - CLOSED

TRANSITION OPEN PAD 2 -

P2-V2 - OPEN

TRANSITION OPEN PAD 2 -

P1-C1 - CLOSE
P1-V1 - CLOSE
P1-BL-V1 - CLOSE

INTEGRATED BYPASS AND FLOWBACK SYSTEMS AND METHODS FOR WELL FRACTURING

RELATED APPLICATION

This application claims the benefit of U.S. Provisional Patent Application 63/692,145 filed by Don Channing Gramlich on Sep. 8, 2024, entitled "Integrated Bypass and Flowback Systems and Methods for Well Fracturing," which is incorporated herein by reference for all purposes.

TECHNICAL FIELD

This application is directed, in general, to methods and systems for fracking gas wells, and more specifically to integrated bypass and flowback systems and methods for well fracturing.

BACKGROUND

The following discussion of the background is intended to facilitate an understanding of the present disclosure only. It should be appreciated that the discussion is not an acknowledgement or admission that any of the material referred to was part of the common general knowledge at the priority date of the application.

Hydraulic fracturing is a technique used to assist in extracting gas or oil from wells. A well bore is first drilled to a desired depth. The well bore is then injected with and charged with high-pressure fracking fluids, which results in the breaking of the subterranean material surrounding the well bore. Fracking fluids may include a mixture of water, sand, and additive chemicals. The breaking or fracturing of the subterranean material surrounding the well bore results in the opening of flow paths for oil or gas to flow from the subterranean material surrounding the well bore into the well bore where the oil or gas can then flow through the well bore to the surface for collection. While procedures, techniques, and systems for well fracturing have been in existence for a long time, improvements are still desired.

SUMMARY

According to an illustrative embodiment a method for fracking at least two wells includes the steps of delivering high pressure fracking fluid to a first frack tree from an original source of high pressure fracking fluid, fracking a first well associated with the first frac tree using the high pressure fracking fluid, delivering high pressure fracking fluid from the first frac tree to a second frac tree through a bypass line fluidly coupled to the first frac tree and the second frac tree while maintaining delivery of the high pressure fracking fluid to the first frac tree from the original source of high pressure fracking fluid, delivering high pressure fracking fluid to the second frac tree from the original source of fracking fluid, and fluidly isolating the first well by stopping delivery of the high pressure fracking fluid to the first frac tree from the original source of fracking fluid and preventing flow of high pressure fluid through the bypass line. The high pressure fluid is continuously supplied by the original source of high pressure fluid while performing the steps of the method.

According to an illustrative embodiment a method for continuous fracking of a plurality of wells includes the steps of supplying high-pressure fracking fluid to a missile assembly fluidly coupled to a zipper manifold, delivering the high-pressure fracking fluid through the first missile manifold to a first frac tree fluidly coupled to the first missile manifold by a bridge while not delivering the high-pressure fracking fluid to a second frac tree fluidly coupled to the second missile manifold, fracking a first well fluidly coupled to the first frac tree, delivering fracking fluid through a bypass line to the second frac tree and to a second well fluidly coupled to the second frac tree, delivering high-pressure fracking fluid through the second missile manifold to the second frac tree and to the second well, preventing the flow of fracking fluid to the first frac tree through the first missile manifold and the bypass line, and fracking the second well. The high-pressure fracking fluid is supplied by a plurality of pump trucks fluidly coupled to the zipper assembly. The missile assembly includes a plurality of missile manifolds including at least a first missile manifold and a second missile manifold. The bypass line is fluidly coupled on a first end to the first frac tree and fluidly coupled on a second end to the second frac tree. The high-pressure fracking fluid is continuously provided by the plurality of pump trucks while performing the steps of fracking the first well, delivering fracking fluid at least temporarily to the second frac tree through the bypass line, delivering high-pressure fracking fluid to the second frac tree through the second missile manifold, preventing the flow of fracking fluid to the first frac tree, and fracking the second well.

In one illustrative embodiment, an apparatus for fracking multiple wells includes a zipper manifold fluidly coupled to a plurality of pump trucks, a missile assembly fluidly coupled to the zipper manifold, a first frac tree in fluid communication with the first missile, a second frac tree in fluid communication with the second missile, a bypass line fluidly coupling the first frac tree and the second frac tree, and a bypass line valve fluidly coupled to the bypass line for selectively allowing or preventing flow of the high pressure fluid between the first frac tree and the second frac tree through the bypass line. Each of the pump trucks supplies high pressure fracking fluid to the zipper manifold. The zipper manifold supplies the high pressure fracking fluid to the missile assembly. The missile assembly comprises at least a first missile and a second missile. The first missile supplies high pressure fluid to the first frac tree. The second missile supplies high pressure fluid to the second frac tree.

Other embodiments are disclosed.

DESCRIPTION OF THE DRAWINGS

Illustrative embodiments of the present disclosure are described in detail below with reference to the attached drawing figures, which are incorporated by reference herein and wherein.

DETAILED DESCRIPTION

Figure 1:
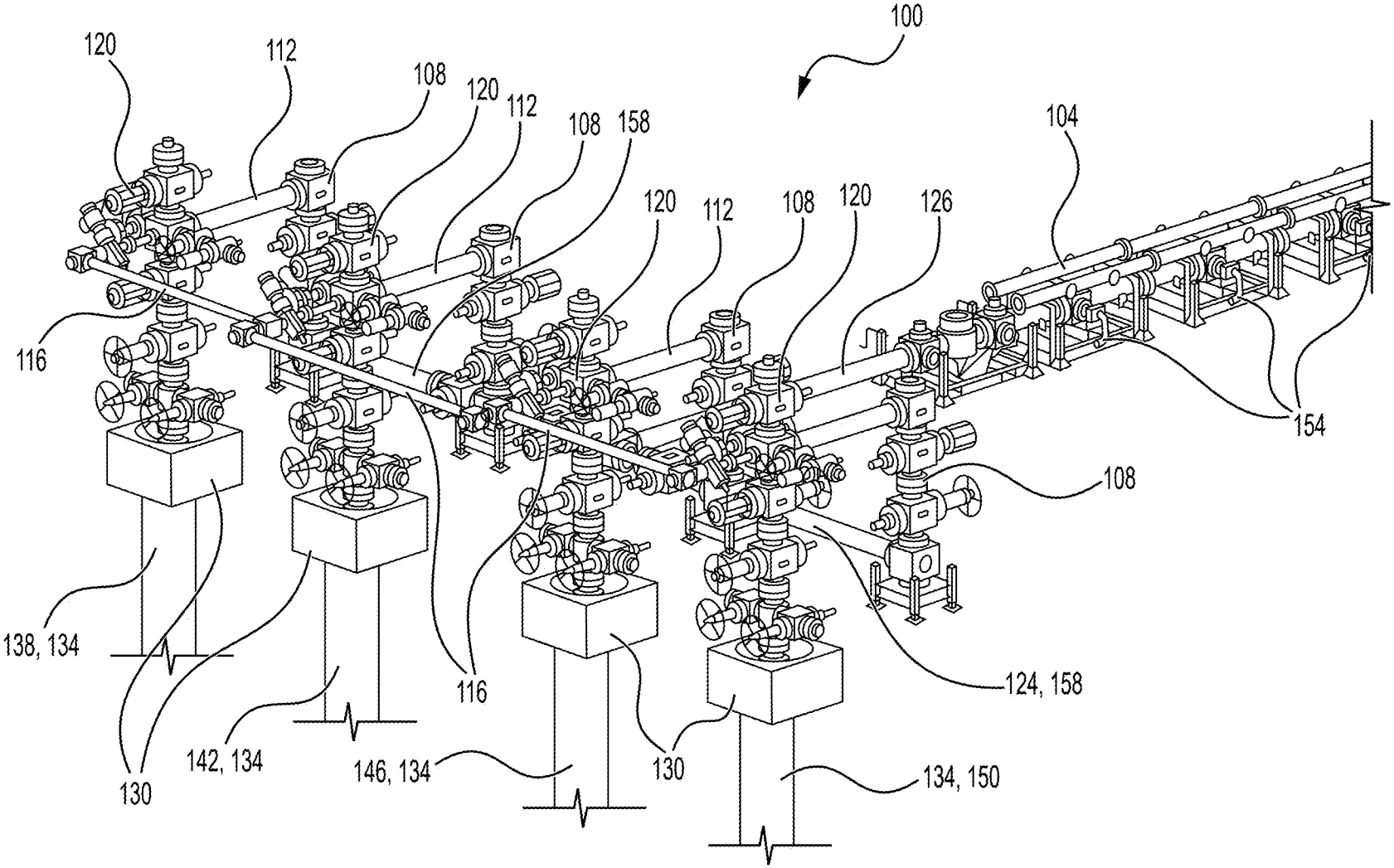
FIG. 1 is a schematic, perspective view of an illustrative embodiment of an integrated bypass and flowback system for well fracturing.

In the following detailed description of the preferred embodiments, reference is made to the accompanying drawings that form a part hereof, and in which is shown, by way of illustration, specific embodiments in which the disclosure may be practiced. These embodiments are described in sufficient detail to enable those skilled in the art to practice the disclosure, and it is understood that other embodiments may be utilized, and that logical structural, mechanical, electrical, and chemical changes may be made without departing from the spirit or scope of the disclosure. To avoid detail not necessary to enable those skilled in the art to practice the disclosure, the description may omit certain information known to those skilled in the art. The following detailed description is, therefore, not to be taken in a limiting sense, and the scope of the present disclosure is defined only by the claims. Unless otherwise indicated, as used throughout this document, "or" does not require mutual exclusivity.

An integrated bypass and flowback system for well fracking utilizes a bypass line during well fracking of multiple pad sites. The use of the bypass line during multi-pad stimulation may allow for the reduction of pump downtime and higher fracking efficiency. This procedure is also known as "continuous fracking".

The integrated bypass and flowback system includes a zipper manifold. The zipper manifold has a plurality of pump truck connections, which are used to fluidly couple the pump trucks to the zipper manifold. The pump trucks have fracking fluid reservoirs and are capable of pumping the fracking fluid at high pressures into a tubular of the zipper manifold. Typically, fracking fluid may be delivered from the pumps trucks in the range of 5,000-20,000 psi. The tubular of the zipper manifold is fluidly coupled to a zipper supply line, which is a tubular that is fluidly coupled to a missile assembly. The missile assembly includes a plurality of missile manifolds with each missile manifold being associated with a well pad of a plurality of well pads. Each missile manifold is fluidly coupled to a frac tree of a particular well pad by a bridge tubular, with each frac tree and well pad being associated with a particular well to be fracked of a plurality of wells.

The integrated bypass and flowback system is capable of performing continuous fracking of the plurality of wells. Fracking fluid, which is pressurized by the pump trucks, is delivered to the missile assembly. The missile assembly distributes the pressurized fracking fluids to the plurality of missile manifolds. The pressurized fluids are then, typically sequentially, delivered to each of the frac trees of a plurality of frac trees though bridges coupled between the missile manifolds and the frac trees. The high pressure fluid is then delivered to the wells through the frac trees.

The flow of fluids through the integrated bypass and flowback system is selectively controlled by operation of a plurality of valves. The zipper manifold, missile manifolds, and frac trees each have a plurality of valves to control fluid flow. By selectively activating particular valves of the plurality of valves of the zipper manifold, missile manifold, and frac trees the pressurized fluid can selectively be delivered to various components of the integrated bypass and flowback system.

Typically, one well of the plurality of wells is fracked at one time. When fracking of a first well is complete, then the plurality of valves is used to direct flow of the pressurized fluid from the first well, which is now fracked, to a second well, which needs to be fracked. In a traditional multi-well fracking processes, the pump trucks are required to idle down to zero or near zero pump rate prior to diverting fracking fluid or sand to other wells on the site. This is required to prevent damage to the fracking system and sand pack-off of equipment within the various manifolds and trees. Requiring pump trucks to idle to zero or near zero pump rate reduces the efficiency of the multi-well fracking process, increases the time needed to complete the fracking process, increases costs associated with the fracking process, and exposes the equipment to downtime, equipment utilization losses, and potential damage.

The bypass line of the integrated bypass and flowback system provides a direct fluid flow between the frac trees of each well pad with a series of valves, chokes, and spools. The primary function of the bypass line is to allow for interconnection between wells and to protect upstream equipment and systems while allowing the pump trucks to continue to run at either full or reduced flow rates. The bypass line also provides operational redundancy.

The bypass line has the added benefit of being isolated from the trees and allowing the integrated bypass and flowback system as a whole to continue fracking. The components of the integrated bypass and flowback system can be isolated from the traditional frac trees or be repaired or replaced in situ.

The secondary function of the bypass line is to double as a flowback or pumpdown line. This eliminates the need for a secondary connection on the frac trees for flowback or pumpdown purposes. The bypass line can be mated to other flowback equipment for the sand separation and flowback stages of well preparation.

The bypass line and frac tree valves can be hydraulically controlled and automated to control the sequence of operation. Automation increases the pad transfer speed and reduces the chances of operator error during operation of the integrated bypass and flowback system.

A method of operation of the integrated bypass and flowback system is used to perform continuous multi-well fracking. The method includes the step of pressurizing a first well with fracking fluids while not pressurizing a second well by delivering pressurized fluid to the first well from a missile assembly; at least partially pressurizing a second well by delivering pressurized fluids from the first well to the second well through a bypass line while maintaining fluid communication between the missile assembly and the first well; sealing the pressurized first well by stopping fluid flow between the missile assembly and the first well and stopping the fluid flow between the first well and the second well through the bypass line; and fracking only the second well by introduction of pressurized fluid into the second well delivered from the missile assembly. As will be explained in more detail below, the above steps of the operation are performed without stopping the flow of pressurized fluids from pump trucks that deliver pressurized fluid to the missile assembly though the zipper manifold. In some embodiments, the steps are performed without any reduction in pressure or fluid flow from the pump trucks. In some embodiments, the steps are performed with a partial reduction in pressure or fluid flow from the pump trucks.

Referring now to the figures and primarily to FIG. 1, the components and operation of an integrated bypass and flowback system 100 will be described. FIG. 1 depicts an illustrative embodiment of the integrated bypass and flowback system 100. The integrated bypass and flowback system 100 is utilized during fracking of a plurality of wells 134. Each of a plurality of frac trees 120 is located and associated with a well pad 130. Typically, each the plurality of wells 134 are fracked one at a time. For example, the first well 138 is first fracked using the integrated bypass and flowback system 100 by delivering high pressure fluid to the first well 138. When the delivery of fracking fluid to the first well 138 is complete, the first well 138 is isolated from the integrated bypass and flowback system 100 so that high pressure fluid is no longer being delivered to the first well 138 and then high pressure fluid is delivered to a second well 142 to begin the fracking process of the second well 142. A third well 146 and a fourth well 150 are subsequently fracked in a sequential manner. The plurality of wells 134 to be fracked may contain any number of individual wells. Four wells 134 are presented as an example.

A zipper manifold 104 is used to supply high pressure fluid from pump trucks into the integrated bypass and flowback system 100. The zipper manifold 104 has a plurality of pump truck stations 154 so that multiple pump trucks can be fluidly coupled to the zipper manifold 104 and supply high pressure fluid to the integrated bypass and flowback system 100 simultaneously. The zipper manifold 104 is used to collect all of the high pressure fluid being delivered by the pump trucks. The high pressure fluid is then delivered to a zipper supply line 126. The high pressure fluid travels through the zipper supply line 126 to a missile assembly 124. The missile assembly 124 includes a plurality of missile manifolds 108 each in fluid communication with each other through missile tubulars 158. Fluid flow through the missile tubulars 158 to and through the missile manifolds 108 is controlled by a plurality of missile valves 162, as shown in FIG. 2.

Figure 2:
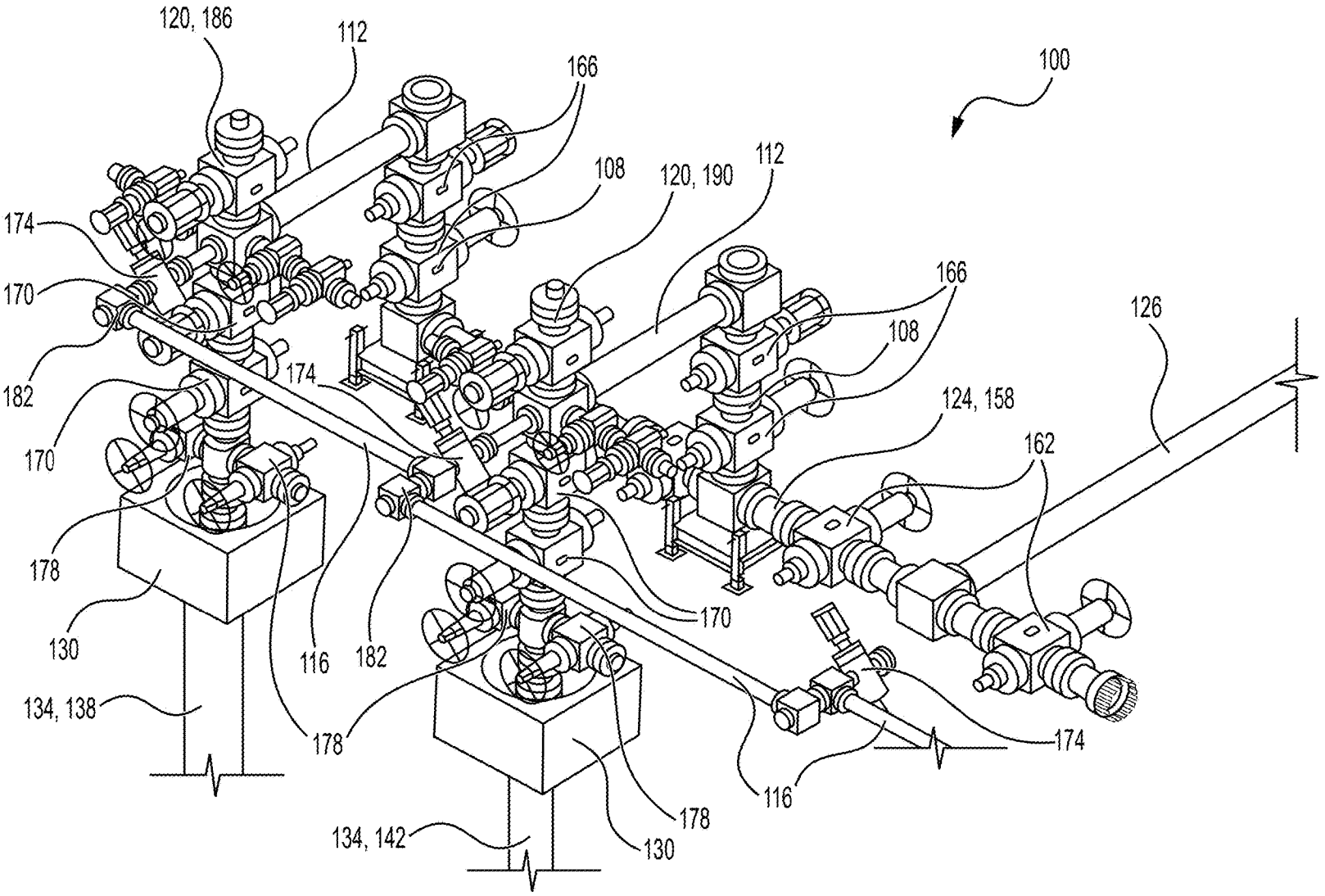
FIG. 2 is a schematic, perspective view of a portion of the illustrative embodiment of the integrated bypass and flowback system for well fracturing of FIG. 1.
Figure 3:
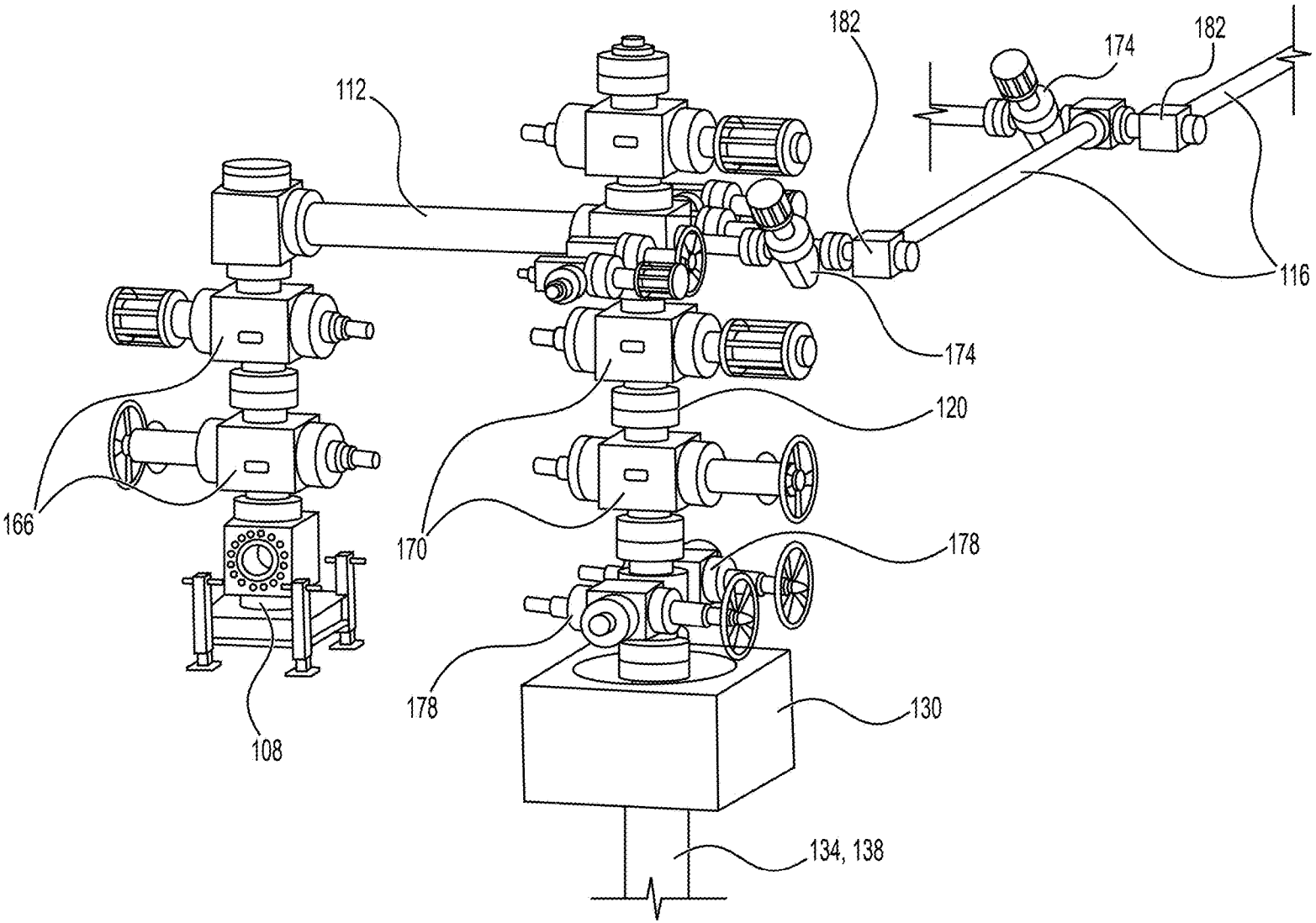
FIG. 3 is a schematic, perspective view of a portion of the illustrative embodiment of the integrated bypass and flowback system for well fracturing of FIG. 1.
Figure 4:
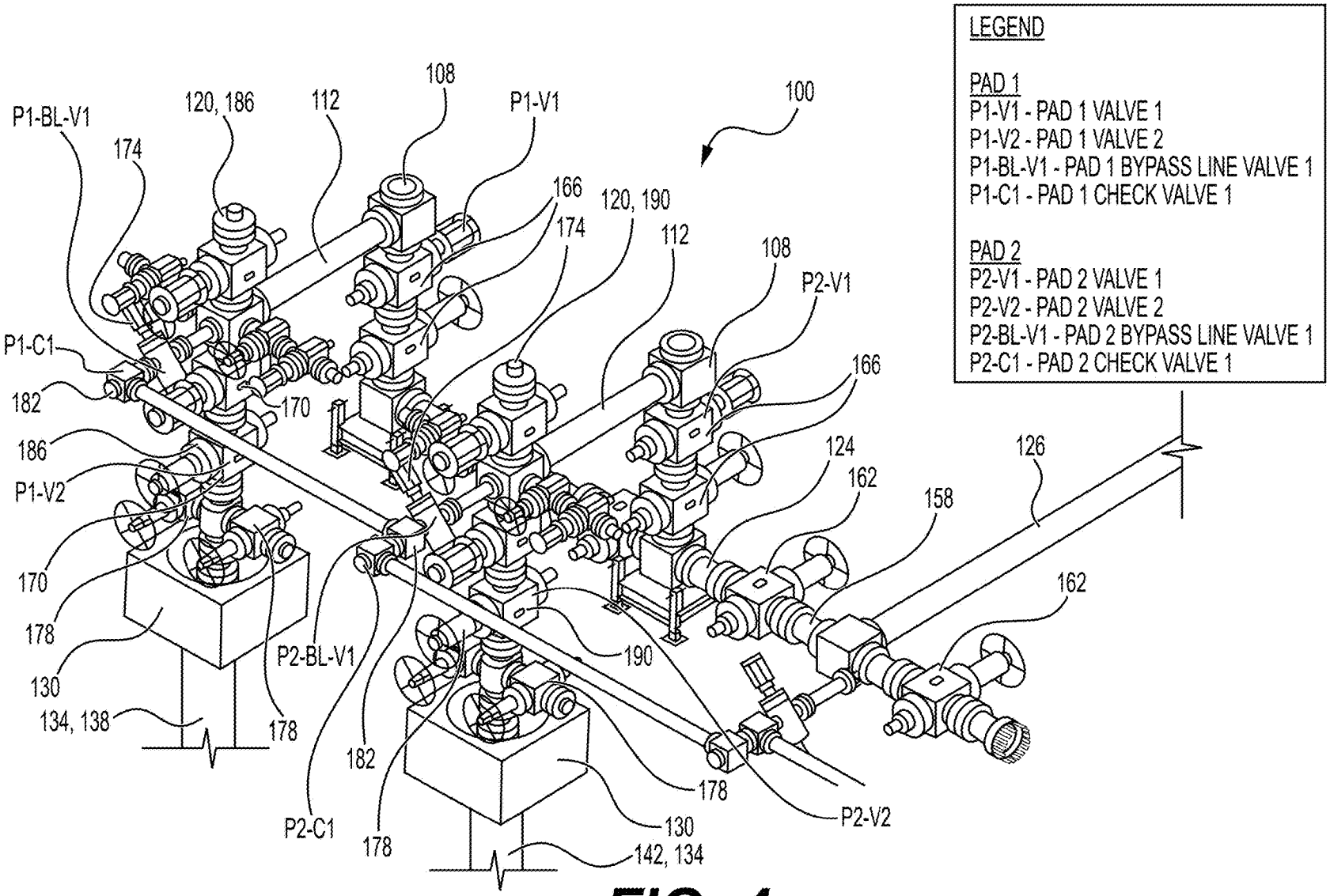
FIG. 4 is a schematic, perspective view of a portion of the illustrative embodiment of the integrated bypass and flowback system for well fracturing of FIG. 1.

Now referring primarily to FIGS. 2 and 3, which each partially depict the integrated bypass and flowback system 100 with some components removed for clarity, each of the missile manifolds 108 is used to control fluid flow from the missile assembly 124 to a particular frac tree 120 associated with a particular missile manifold 108. Each frac tree 120 is mounted onto a particular well pad 130 that is associated with a particular well 134. A plurality of missile manifold valves 166 are used to control fluid flow from the particular missile manifold 108 to the particular frac tree 120 associated with that particular missile manifold 108. Fluid is delivered to the frac tree 120 from the missile manifold 108 through a bridge 112, which fluidly couples the missile manifold 108 with the frac tree 120.

Fluid flow through the frac tree 120 is controlled by a plurality of frac tree valves 170 and a bypass valve 174. The frac tree valves 170 are used to control flow of high pressure fluid from the frac tree 120 to the well 134. The bypass valve 174 is used to control the flow of fluid from the frac tree 120 to a bypass line 116.

The bypass line 116 fluidly couples each of the plurality of the frac trees 120 to each other and fluid flow between the bypass line 116 to or from particular frac trees 120 occurs through the bypass line 116. The flow of fluid from or through the bypass line 116 to or from frac trees 120 is controlled by a check valve 182 associated with each frac tree 120 and located between the bypass valve 174 and the bypass line 116 of each particular frac tree 120. The check valve 182 can be used to allow for one direction of fluid flow through the check valve 182 while preventing fluid flow in the other direction through the check valve 182.

It should be noted that the integrated bypass and flowback system 100 of FIGS. 1-3 is illustrative in nature and other variations of components, such as the missile assemblies 108 and of the frac trees 120 may be used. For example, in the illustrative embodiment of FIGS. 1-3, the missile assemblies 108 each have two missile manifold valves 166 with one being a hydraulic valve and the other being a manual valve. Likewise, the frac trees 120 are depicted with two frac tree valves 170 with one being a hydraulic valve and the other being a manual valve. Other embodiments of the integrated bypass and flowback system 100 may use different numbers or types of valves. Also, for example, in the illustrative embodiment of the integrated bypass and flowback system 100, as depicted, the frac trees 120 each have accessory attachment points and valves 178, which may be used for servicing the well 134 or other purposes. In other embodiments of the integrated bypass and flowback system 100, other numbers of accessory attachment points and valves 178 may be used on the frac tree 120 or the accessory attachment points and valves 178 may not be present on the frac tree 120.

Now referring primarily to FIGS. 4-11, the operation of the integrated bypass and flowback system 100 while fracking multiple wells 134 will be described. Note, in FIGS. 5-11, valve open or valve flow symbols have been superimposed along with some flow indications. A valve is indicated as being open by an open circle. A valve is indicated as being close by a circle with a line through the circle. Furthermore, flow arrows 139 have been superimposed upon components of the integrated bypass and flowback system 100 shown in FIGS. 5-11 to indicate the flow of fluids through the various tubulars and components of the integrated bypass and flowback system 100 at the particular depicted step of the process.

The process will be described in relation to first fracking the first well 138 followed by fracking of the second well 142. It should be understood that "first" and "second" are used for clarity and orientation purposes in relation to describing the operation of the integrated bypass and flowback system 100. Any number of wells 134 may be fracked by the integrated bypass and flowback system 100 in any desired order.

Figure 5:
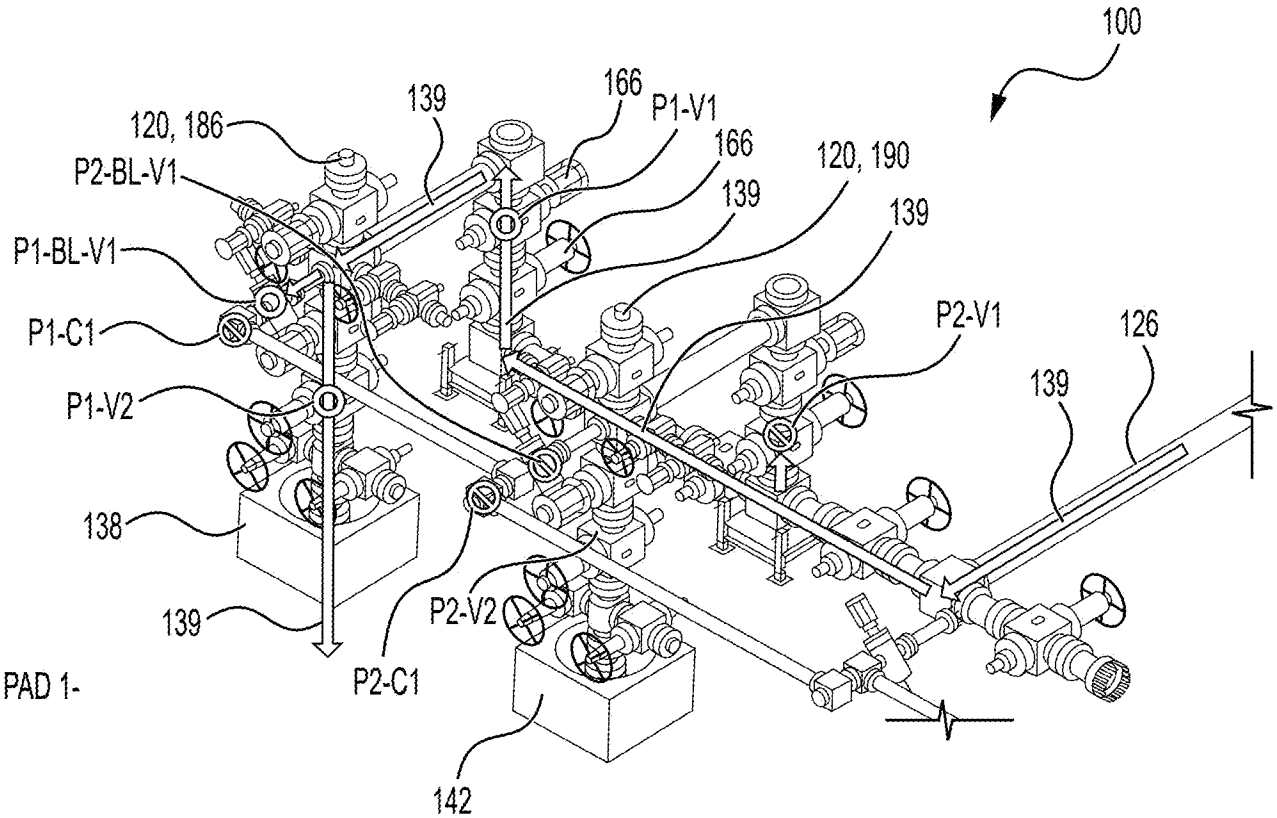
FIG. 5 is a schematic, perspective view of a portion of the illustrative embodiment of the integrated bypass and flowback system for well fracturing of FIG. 1 depicting the flow of fluids and the status of valves during a step of an illustrative method of continuous well fracking.

In the illustrative embodiment, the first well 138 is fracked in a manner similar to that of traditional multi-well fracking, as depicted in FIG. 5. The pump trucks provide high-pressure fracking fluid to the zipper manifold 104, which is in turn delivered to the missile assembly 124. The missile valves 162 and the missile manifold valves 166 are configured so that the high pressure fluid is delivered to a first frac tree 186 and not to any of the other frac trees 120. This status is shown in FIG. 5, where valve P1-V1 is open, valve P1-BL-V1 is open, valve P1-V2 is open, valve P1-C1 is closed, and valve P2-C1 is closed. In this valve configuration, the first well 138 is subjected to high pressure fluid and there is no fluid flow to a second frac tree 190. The configuration is maintained until the first well 138 has been sufficiently subjected to high-pressure fracking fluid. After which point, the desire is to isolate the first well 138 under pressure while immediately introducing high pressure fluids to the second well 142, takes place. The flow is shown by flow arrows 139.

Figure 6:
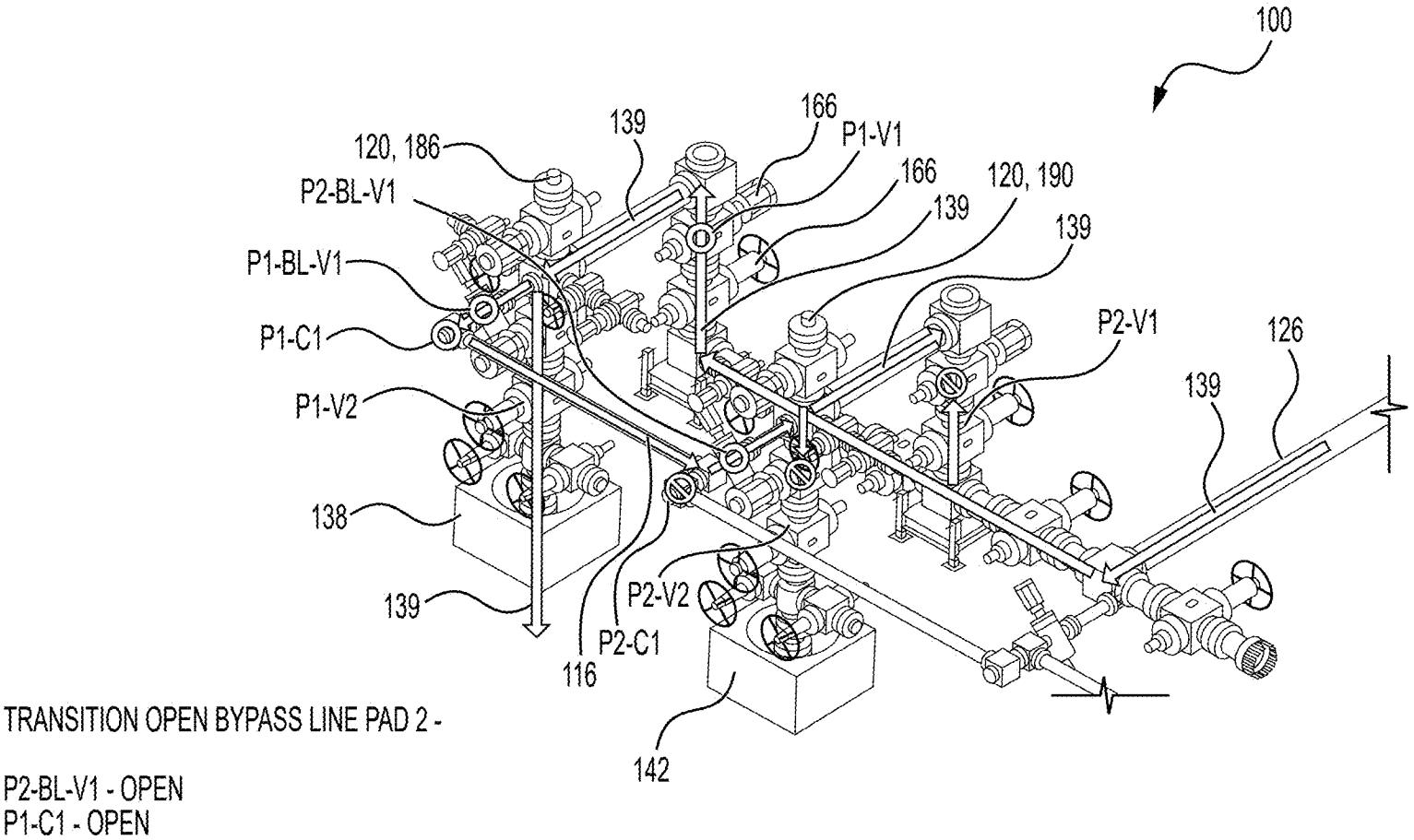
FIG. 6 is a schematic, perspective view of a portion of the illustrative embodiment of the integrated bypass and flowback system for well fracturing of FIG. 1 depicting the flow of fluids and the status of valves during a step of an illustrative method of continuous well fracking.

The operation proceeds to the next step, which is depicted in FIG. 6. At this time the valve P2-BL-V1 on the second frack tree 190 is opened and the valve P1-C1 is opened. All the other valves remain the same as in the first step. This configuration allows for high pressure fluid to flow into the bypass line 116 between the first frac tree 186 and the second frac tree 190 and into the top portion of the second frac tree 190, while still flowing at the first frac tree 186.

Figure 7:
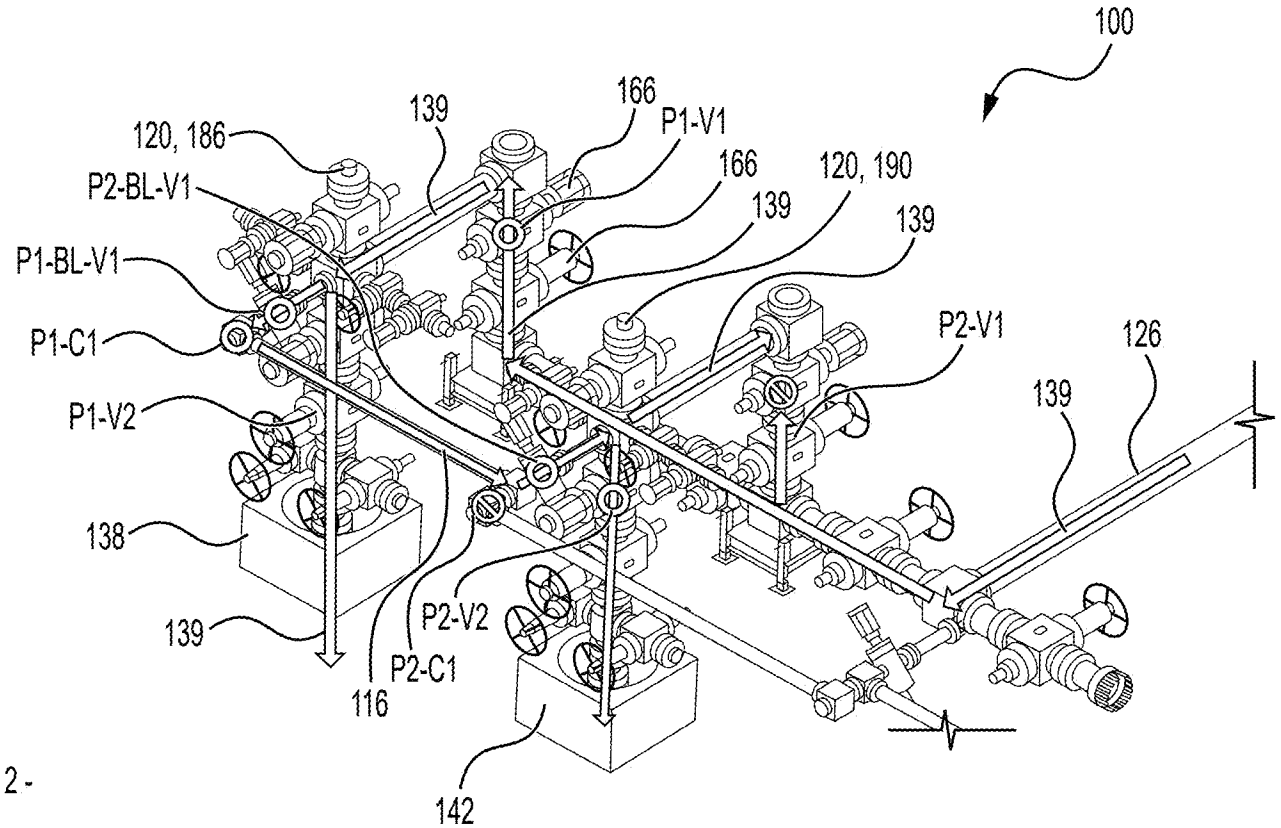
FIG. 7 is a schematic, perspective view of a portion of the illustrative embodiment of the integrated bypass and flowback system for well fracturing of FIG. 1 depicting the flow of fluids and the status of valves during a step of an illustrative method of continuous well fracking.

The next step of the operation is depicted in FIG. 7. In this step the valve P2-V2 is opened while all other valves remain in their previous state. This allows for high pressure fluid to flow from the top portion of the second frac tree 190 into the second well 142. This allows for the pressurization of the second well 142 to begin without losing substantial pressurization of the first well 138. The flow path is shown by arrows 139.

Figure 8:
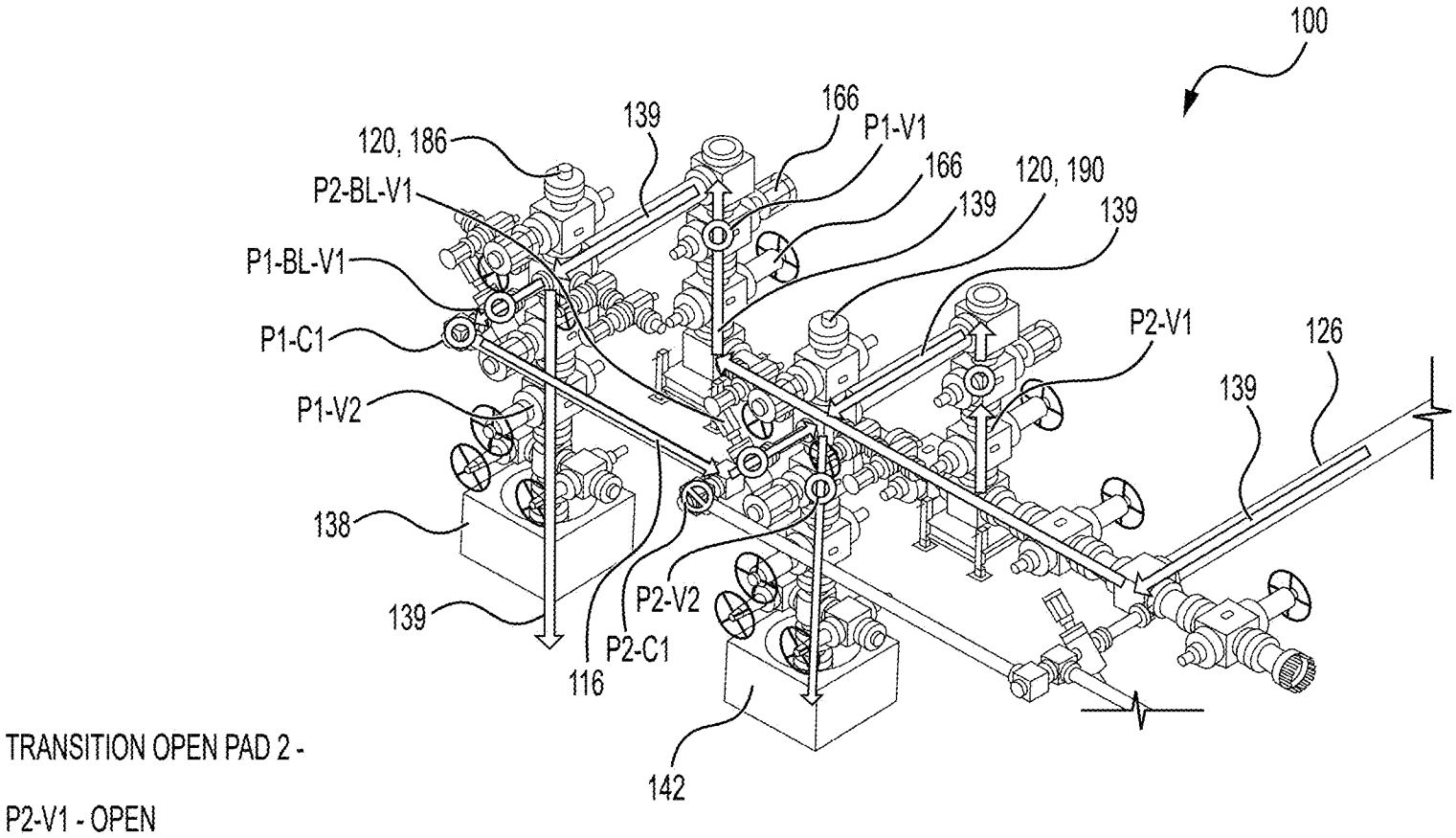
FIG. 8 is a schematic, perspective view of a portion of the illustrative embodiment of the integrated bypass and flowback system for well fracturing of FIG. 1 depicting the flow of fluids and the status of valves during a step of an illustrative method of continuous well fracking.

The next step of the operation is depicted in FIG. 8. In this step the valve P2-V1 is opened. All other valves remain in their previous state. The opening of valve P2-V1 allows for full fluid flow from the missile assembly 124 to flow into the second frac tree 190 and into the second well 142. Since the second well 142 or at least the second frac tree 190 and the bypass line 116 between the first frac tree 186 and the second frac tree 190 are already in a high pressure state, the second well 142 is pressurized without substantial loss of pressure in the first well 138. The flow is shown by flow arrows 139.

Figure 9:
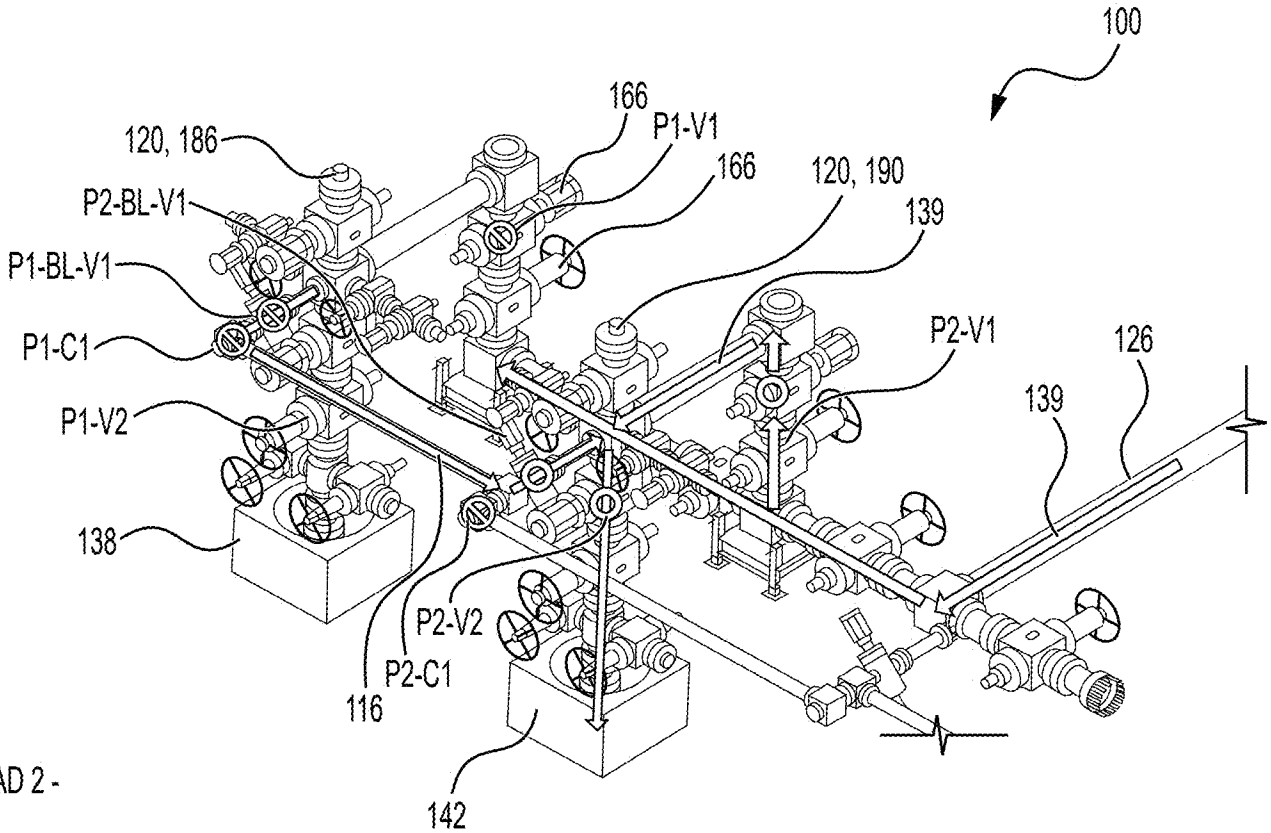
FIG. 9 is a schematic, perspective view of a portion of the illustrative embodiment of the integrated bypass and flowback system for well fracturing of FIG. 1 depicting the flow of fluids and the status of valves during a step of an illustrative method of continuous well fracking.
Figure 10:
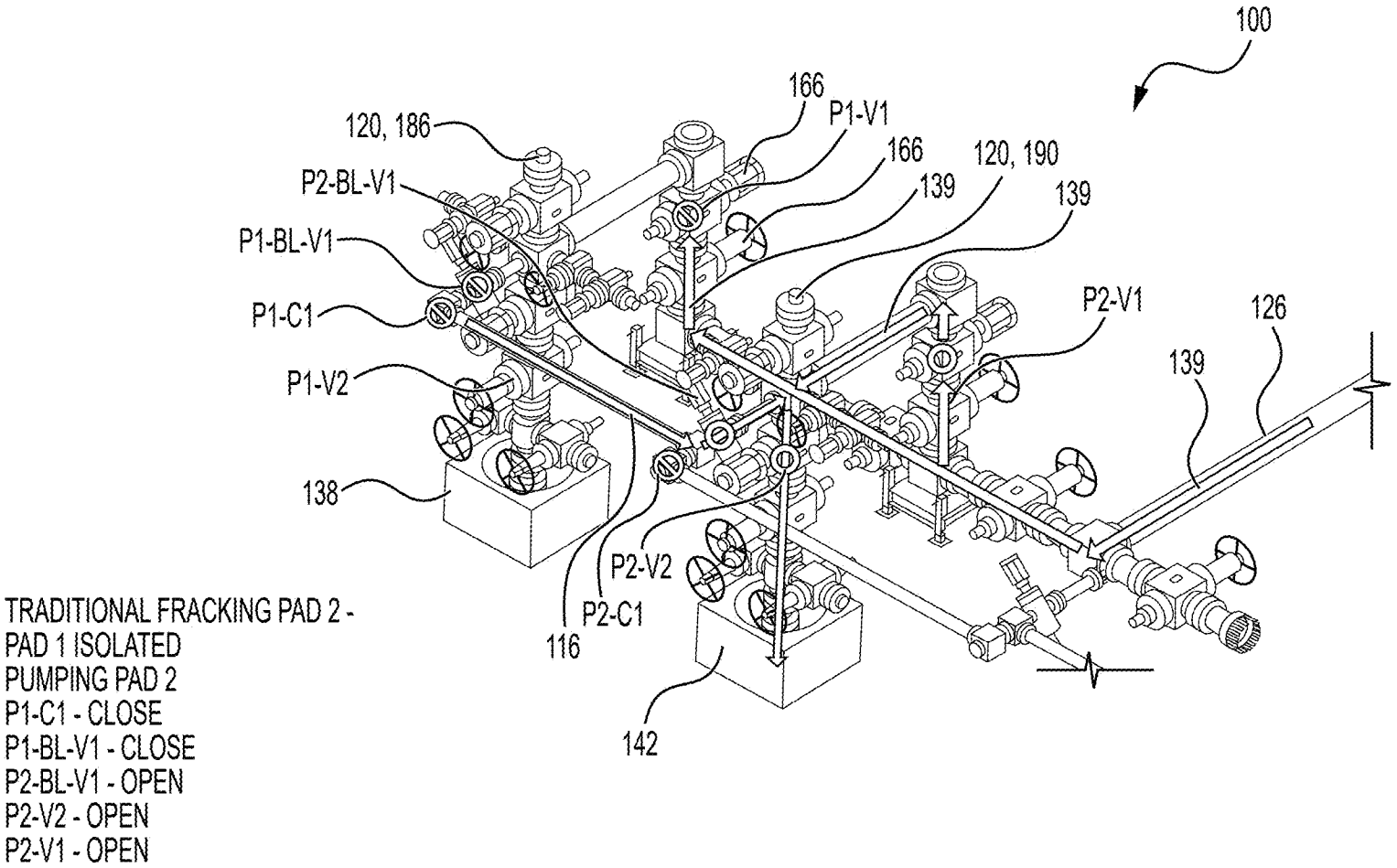
FIG. 10 is a schematic, perspective view of a portion of the illustrative embodiment of the integrated bypass and flowback system for well fracturing of FIG. 1 depicting the flow of fluids and the status of valves during a step of an illustrative method of continuous well fracking.

The next step of the operation is depicted in FIGS. 9 and 10. In this step the valve P1-C1 is closed thereby shutting off flow in the bypass line 116 between the first frac tree 186 and the second frac tree 190. In addition, the valve P1-V1 is closed, and the valve P1-BL-V1 is closed. All other valves remain in their previous state. The closing of valves P1-V1, P1-BL-V1, and P1-C1 isolates the first well 138 from the remainder of the system while maintaining the desired pressure levels within the first well 138. The closing of valves P1-V1, P1-BL-V1, and P1-C1 also results in all of the fracking fluid being directed into the second well 142 through the second frac tree 190.

Figure 11:
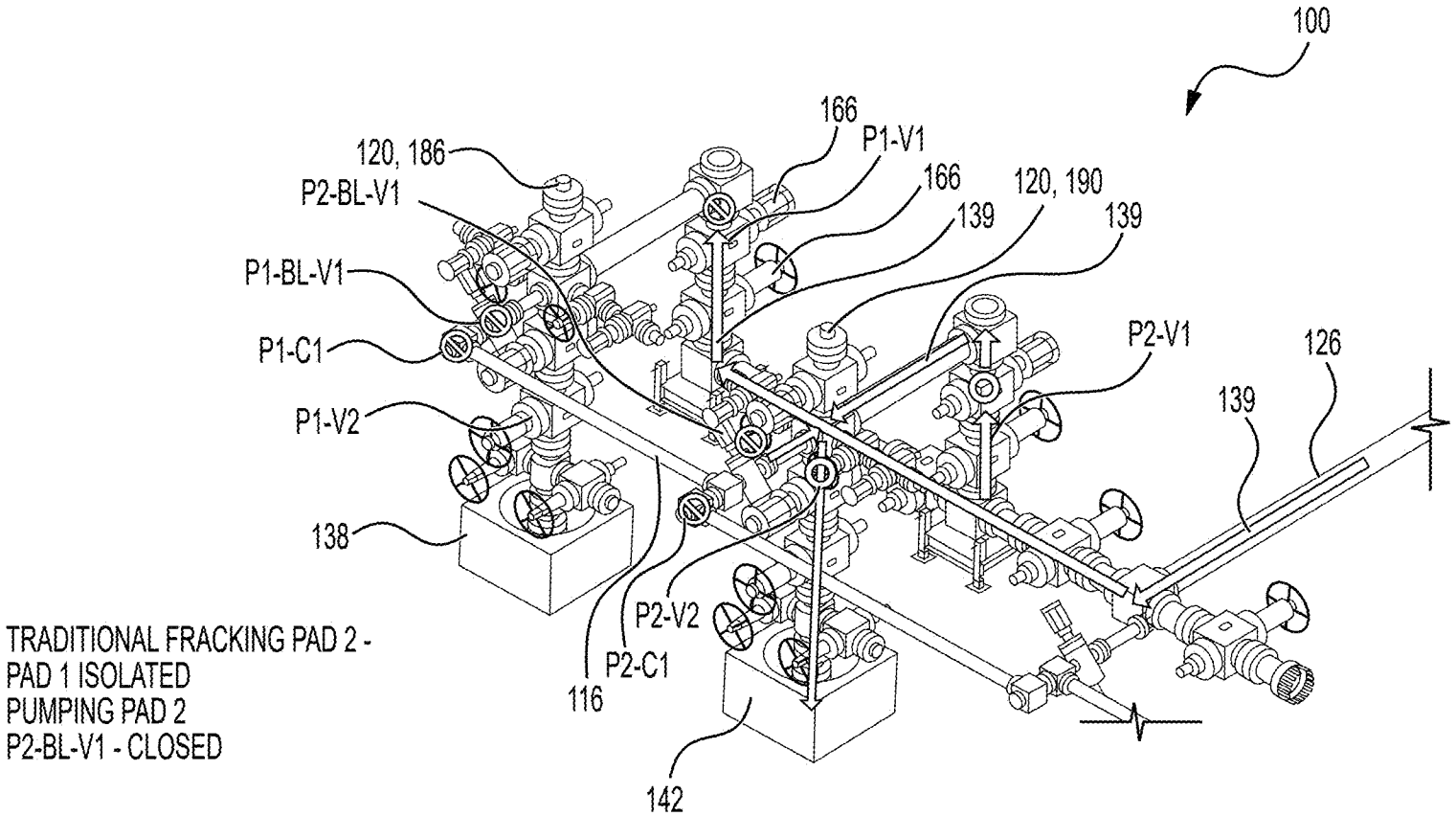
FIG. 11 is a schematic, perspective view of a portion of the illustrative embodiment of the integrated bypass and flowback system for well fracturing of FIG. 1 depicting the flow of fluids and the status of valves during a step of an illustrative method of continuous well fracking.

In the final step, as depicted in FIG. 11, the valve P2-BL-V1, which is the bypass valve 174 of the second frac tree 190, is closed. This prevents further fluid flow into the bypass line 116. At this point fracking of the second well 142 continues until completion, after which point, the process is repeated for the next well 134 to be fracked.

The above steps of the operation of the integrated bypass and flowback system 100 are performed without the need to stop the flow of fracking fluids from the pump trucks. In some embodiments, the steps of the operation are performed without reducing the flow rate of fracking fluids from the pump trucks. In other embodiments, the steps of the operation of the integrated bypass and flowback system 100 are performed with a partial reduction in flow from the pump trucks. In some embodiments, the steps of the above illustrative method are performed while maintain the high pressure fluid in the missile manifold 108 or supplied from the pump trucks at a least 5,000 psi. In some embodiments, the steps of the above illustrative method are performed while maintain the high pressure fluid in the missile manifold 108 or supplied from the pump trucks at a least 10,000 psi. While pump trucks are typical for use as the original source of high pressure fracking fluid, other sources of high pressure frac fluids may be used to supply the zipper supply line 126 or missile manifold 108.

In any of the above steps involving the opening and or closing of a valve, the valve may be quickly switched between fully opened to fully closed or vice versa or the valve may be initially partially opened or closed or throttled to allow for additional fluid control and gradual changes in pressurization between the two sides of the valve.

In any of the above steps any valves may be manually operated valves, hydraulically operated valves, electronically operated valves, or any other suitably operated valve type. Some or all of the valves may be computer controlled to allow for more precise valve operation and valve opening and closing.

Figure 12:
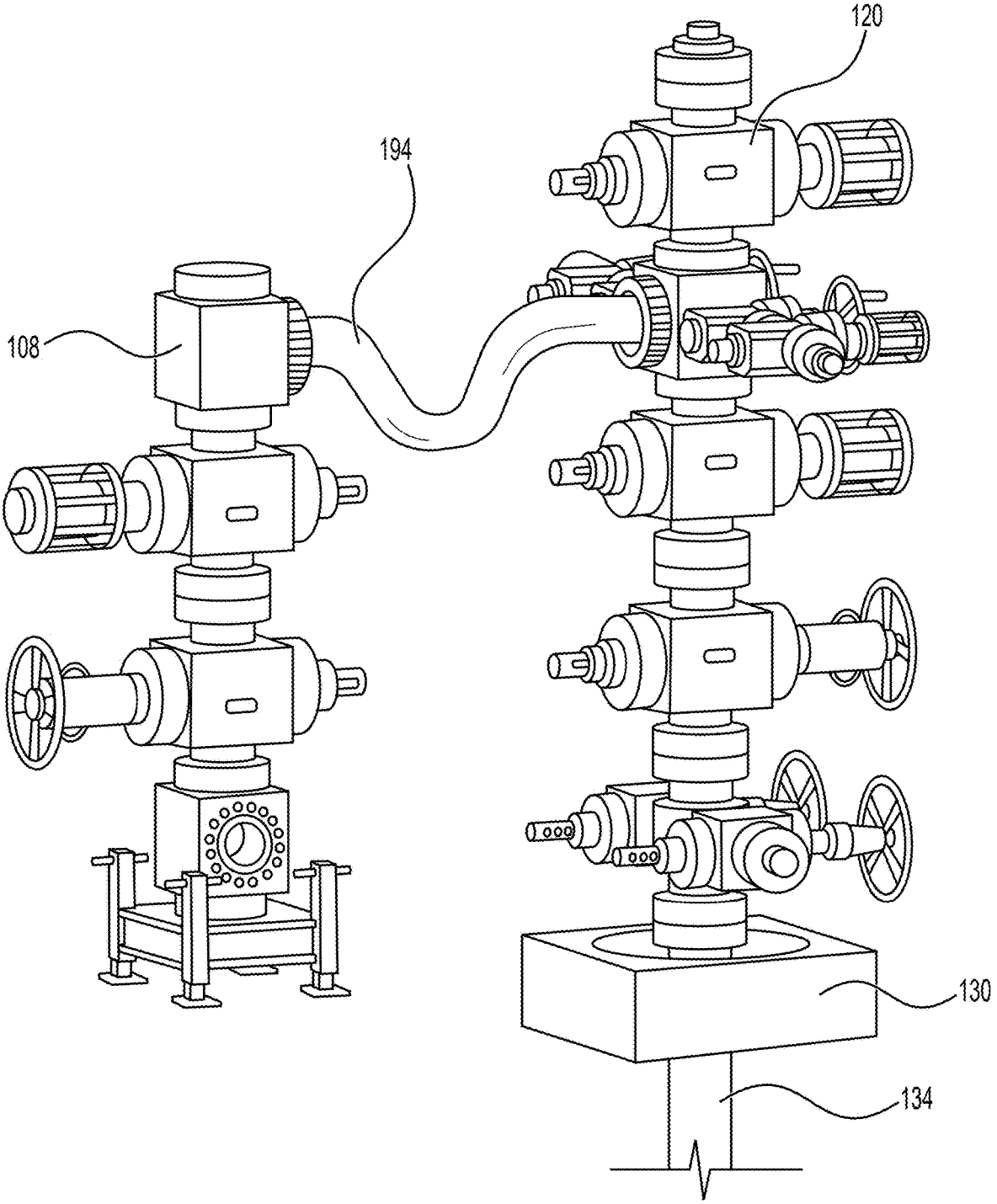
FIG. 12 is a schematic, perspective view of a portion of an illustrative embodiment of an integrated bypass and flowback system for well fracturing utilizing a flexible line connection between a frac tree and a missile manifold.
Figure 13:
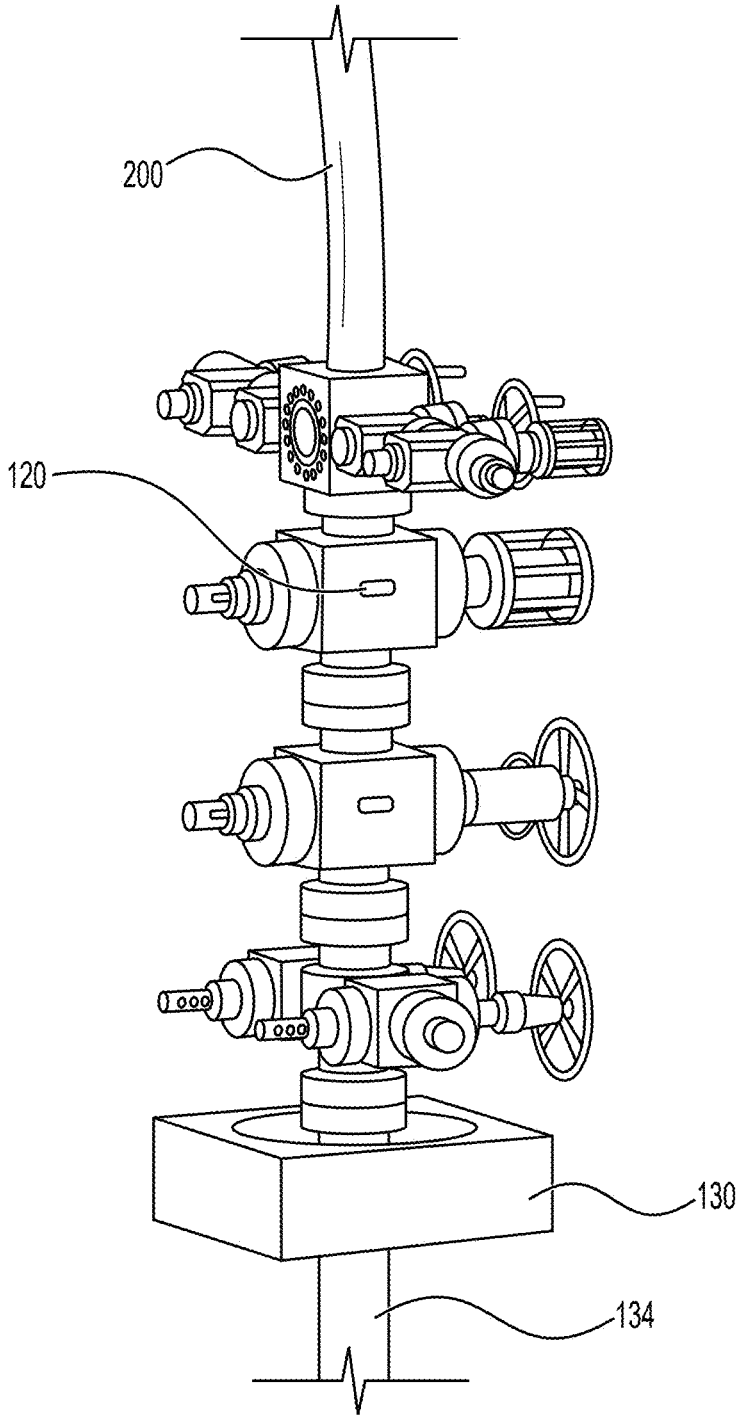
FIG. 13 is a schematic, perspective view of a portion of an illustrative embodiment of an integrated bypass and flowback system for well fracturing utilizing an overhead line connection to a frac tree to deliver fracking fluid to the frac tree.
Figure 14:
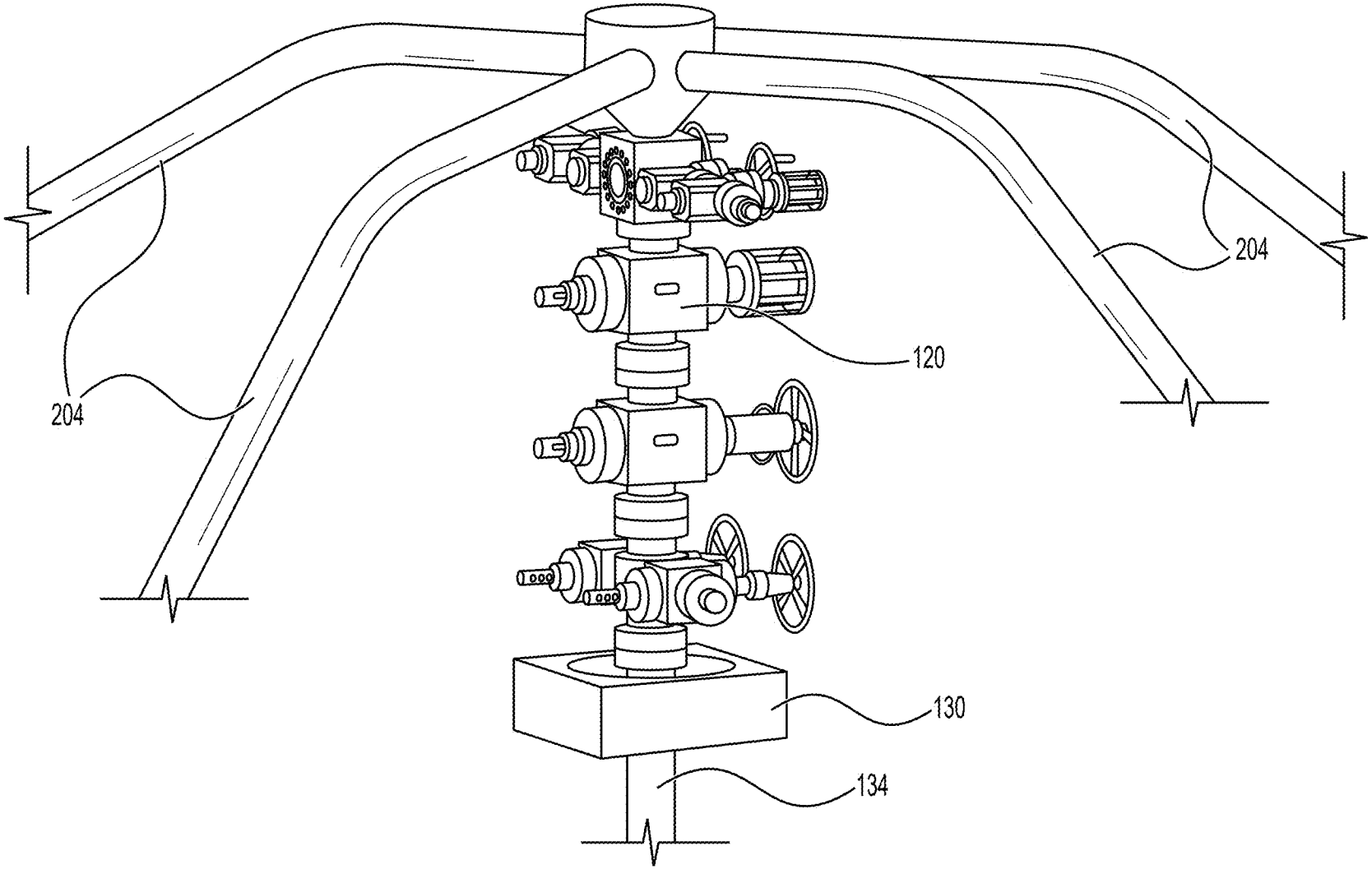
FIG. 14 is a schematic, perspective view of a portion of an illustrative embodiment of an integrated bypass and flowback system for well fracturing utilizing a goathead connection to a frac tree to deliver fracking fluid to the frac tree.

While the illustrative embodiment of the integrated bypass and flowback system 100 depicted in FIGS. 1-11 utilize the bridge 112 to deliver fracking fluid from the missile manifolds 108 to the frac trees 120, it should be understood that other embodiments of the integrated bypass and flowback system 100 utilize other components to deliver the fracking fluid to the frac trees 120. The system 100 would otherwise be analogous to the previously presented embodiments. Examples of other ways to deliver fracking fluid to the frac trees 120 are shown in FIGS. 12-14. As depicted in FIG. 12, a flexible line 194 may be used to fluidly couple the missile manifolds 108 to the frac trees 120. As depicted in FIG. 13, an overhead line 200 may be used to deliver fracking fluid to the frac trees 120. As depicted in FIG. 14, a goat head 204 with multiple orifices may be used to deliver fracking fluid to the frac trees 120.

There are many examples of the various embodiments described herein. A number of examples also follow:

Example 1. A method for continuous fracking of a plurality of wells comprising the steps of:

supplying high-pressure fracking fluid to a missile assembly fluidly coupled to a zipper manifold, wherein the high-pressure fracking fluid is supplied by a plurality of pump trucks fluidly coupled to the zipper assembly and wherein the missile assembly comprises a plurality of missile manifolds including at least a first missile manifold and a second missile manifold;

delivering the high-pressure fracking fluid through the first missile manifold to a first frac tree fluidly coupled to the first missile manifold by a bridge while not delivering the high-pressure fracking fluid to a second frac tree fluidly coupled to the second missile manifold;

fracking a first well fluidly coupled to the first frac tree;

delivering fracking fluid through a bypass line to the second frac tree and to a second well fluidly coupled to the second frac tree, wherein the bypass line is fluidly coupled on a first end to the first frac tree and fluidly coupled on a second end to the second frac tree;

delivering high-pressure fracking fluid through the second missile manifold to the second frac tree and to the second well;

preventing the flow of fracking fluid to the first frac tree through the first missile manifold and the bypass line;

fracking the second well; and wherein the high-pressure fracking fluid is continuously provided by the plurality of pump trucks while performing the steps of fracking the first well, delivering fracking fluid at least temporarily to the second frac tree through the bypass line, delivering high-pressure fracking fluid to the second frac tree through the second missile manifold, preventing the flow of fracking fluid to the first frac tree, and fracking the second well.

Although the present disclosure and its advantages have been disclosed in the context of certain illustrative, non-limiting embodiments, it should be understood that various changes, substitutions, permutations, and alterations can be made without departing from the scope of the disclosure as defined by the claims. It will be appreciated that any feature that is described in a connection to any one embodiment may also be applicable to any other embodiment.

What is claimed:

1. A method for fracking at least two wells comprising the steps of:

delivering high pressure fracking fluid to a first frack tree from an original source of high pressure fracking fluid;

fracking a first well associated with the first frac tree using the high pressure fracking fluid;

delivering high pressure fracking fluid from the first frac tree to a second frac tree through a bypass line fluidly coupled to the first frac tree and the second frac tree while maintaining delivery of the high pressure fracking fluid to the first frac tree from the original source of high pressure fracking fluid;

delivering high pressure fracking fluid to the second frac tree from the original source of fracking fluid;

fluidly isolating the first well by stopping delivery of the high pressure fracking fluid to the first frac tree from the original source of fracking fluid and preventing flow of high pressure fluid through the bypass line; and wherein the high pressure fluid is continuously supplied by the original source of high pressure fluid while performing the steps of the method.

2. The method of claim 1 further comprising:

a manifold assembly fluidly coupling the first frac tree, the second frac tree, and the original source of high pressure fracking fluid; and wherein the high pressure fluid is delivered from the original source of high pressure fluid to first frac tree and the second frac tree through the manifold assembly.

3. The method of claim 2, wherein the manifold assembly comprises a first manifold and a second manifold;

wherein high pressure fluid is delivered to the first frac tree through the first manifold; and wherein the high pressure fluid is delivered to the second frac tree through the second manifold.

4. The method of claim 3, wherein the step of delivering high pressure fracking fluid to a first frack tree from an original source of high pressure fracking fluid is performed by opening a first valve of the first manifold; and wherein the step of fluidly isolating the first well by stopping delivery of the high pressure fracking fluid to the first frac tree from the original source of fracking fluid and preventing flow of high pressure fluid through the bypass line is performed by closing the first valve of the first manifold and closing a bypass valve that is fluidly coupled between the first frac tree and the bypass line.

5. The method of claim 3, wherein the step of delivering high pressure fracking fluid from the first frac tree to a second frac tree through a bypass line fluidly coupled to the first frac tree and the second frac tree while maintaining delivery of the high pressure fracking fluid to the first frac tree from the original source of high pressure fracking fluid is performed by opening a bypass valve that is fluidly coupled between the first frac tree and the bypass line.

6. The method of claim 1 wherein the high pressure fluid is continuously supplied by the original source of high pressure fluid while performing the steps of the method with a pressure of at least 10,000 psi.

7. The method of claim 1 wherein the high pressure fluid is continuously supplied by the original source of high pressure fluid while performing the steps of the method with a pressure of at least 5,000 psi.

8. The method of claim 1, further comprising:

a manifold assembly fluidly coupling the first frac tree, the second frac tree, and the original source of high pressure fracking fluid;

wherein the high pressure fluid is delivered from the original source of high pressure fluid to first frac tree and the second frac tree through the manifold assembly;

wherein the step of delivering high pressure fracking fluid to a first frack tree from an original source of high pressure fracking fluid is performed by opening a first valve of the first manifold;

wherein the step of fluidly isolating the first well by stopping delivery of the high pressure fracking fluid to the first frac tree from the original source of fracking fluid and preventing flow of high pressure fluid through the bypass line is performed by closing the first valve of the first manifold and closing a bypass valve that is fluidly coupled between the first frac tree and the bypass line; and wherein the step of delivering high pressure fracking fluid from the first frac tree to a second frac tree through a bypass line fluidly coupled to the first frac tree and the second frac tree while maintaining delivery of the high pressure fracking fluid to the first frac tree from the original source of high pressure fracking fluid is performed by opening a bypass valve that is fluidly coupled between the first frac tree and the bypass line.

9. The method of claim 8, wherein the high pressure fluid is continuously supplied by the original source of high pressure fluid while performing the steps of the method with a pressure of at least 10,000 psi.

10. The method of claim 8, wherein the high pressure fluid is continuously supplied by the original source of high pressure fluid while performing the steps of the method with a pressure of at least 5,000 psi.

11. The method of claim 8, wherein the original source of high pressure fracking fluid is a zipper manifold that is fluidly coupled to a plurality of pump trucks.

12. The method of claim 1, wherein the original source of high pressure fracking fluid is a zipper manifold that is fluidly coupled to a plurality of pump trucks.

13. A method for continuous fracking of a plurality of wells comprising the steps of:

supplying high-pressure fracking fluid to a missile assembly fluidly coupled to a zipper manifold, wherein the high-pressure fracking fluid is supplied by a plurality of pump trucks fluidly coupled to the zipper assembly and wherein the missile assembly comprises a plurality of missile manifolds including at least a first missile manifold and a second missile manifold;

delivering the high-pressure fracking fluid through the first missile manifold to a first frac tree fluidly coupled to the first missile manifold by a bridge while not delivering the high-pressure fracking fluid to a second frac tree fluidly coupled to the second missile manifold;

fracking a first well fluidly coupled to the first frac tree;

delivering fracking fluid through a bypass line to the second frac tree and to a second well fluidly coupled to the second frac tree, wherein the bypass line is fluidly coupled on a first end to the first frac tree and fluidly coupled on a second end to the second frac tree;

delivering high-pressure fracking fluid through the second missile manifold to the second frac tree and to the second well;

preventing the flow of fracking fluid to the first frac tree through the first missile manifold and the bypass line;

fracking the second well; and wherein the high-pressure fracking fluid is continuously provided by the plurality of pump trucks while performing the steps of fracking the first well, delivering fracking fluid at least temporarily to the second frac tree through the bypass line, delivering high-pressure fracking fluid to the second frac tree through the second missile manifold, preventing the flow of fracking fluid to the first frac tree, and fracking the second well.

14. The method of claim 13, wherein the high pressure fluid is continuously supplied by the plurality of pump trucks while performing the steps of the method with a pressure of at least 10,000 psi.

15. The method of claim 13, wherein the high pressure fluid is continuously supplied by the plurality of pump trucks while performing the steps of the method with a pressure of at least 5,000 psi.

16. The method of claim 13, wherein the step of delivering the high-pressure fracking fluid through the first missile manifold to a first frac tree fluidly coupled to the first missile manifold by a bridge while not delivering the high-pressure fracking fluid to a second frac tree fluidly coupled to the second missile manifold is performed by opening a valve of the first missile manifold to allow fluid flow from the first missile manifold to the first frac tree and closing a valve of the second missile manifold to prevent fluid flow from the second missile manifold to the second frac tree.

17. The method of claim 13, wherein the step of delivering fracking fluid through a bypass line to the second frac tree and to a second well fluidly coupled to the second frac tree is performed by opening a valve fluidly coupled between the first frac tree and the bypass line.

18. An apparatus for fracking multiple wells comprising:

a zipper manifold fluidly coupled to a plurality of pump trucks, wherein each of the pump trucks supplies high pressure fracking fluid to the zipper manifold;

a missile assembly fluidly coupled to the zipper manifold, wherein the zipper manifold supplies the high pressure fracking fluid to the missile assembly, wherein the missile assembly comprises at least a first missile and a second missile;

a first frac tree in fluid communication with the first missile, wherein the first missile supplies high pressure fluid to the first frac tree;

a second frac tree in fluid communication with the second missile, wherein the second missile supplies high pressure fluid to the second frac tree;

a bypass line fluidly coupling the first frac tree and the second frac tree; and a bypass line valve fluidly coupled to the bypass line for selectively allowing or preventing flow of the high pressure fluid between the first frac tree and the second frac tree through the bypass line.

19. The apparatus of claim 18 further comprising:

at least one first missile valve for selectively allowing or preventing flow of the high pressure fluid between the first missile and the first frac tree; and at least one second missile valve for selectively allowing or preventing flow of the high pressure fluid between the second missile and the second frac tree.

20. The apparatus of claim 18, further comprising a check valve fluidly coupled to the bypass line; and wherein the check valve allows for fluid flow from the first frac tree to the second frac tree while blocking flow from the second frac tree to the first frac tree.

* * * * *